United States Patent [19]

Yamazaki

[11] 4,022,323

[45] May 10, 1977

[54] PACKING CASE ASSEMBLY OF A SET OF DECORATION LAMPS

[76] Inventor: Yasuo Yamazaki, 4-15-33 Shimorenjaku, Mitaka, Tokyo, Japan

[22] Filed: Dec. 3, 1975

[21] Appl. No.: 637,323

[30] Foreign Application Priority Data

Dec. 5, 1974 Japan ..... 49-146266

[52] U.S. Cl. ..... 206/419; 206/45.34; 206/328

[51] Int. Cl.[2] ..... B65D 85/42

[58] Field of Search ..... 206/328, 329, 334, 419, 206/420, 423, 45.14, 45.19, 45.34, 351

[56] References Cited

UNITED STATES PATENTS

| | | | |
|---|---|---|---|
| 1,899,666 | 2/1933 | Buschman | 206/45.14 |
| 1,981,731 | 11/1934 | Holy | 206/45.19 |
| 2,872,032 | 2/1959 | West | 206/329 |
| 3,633,089 | 1/1972 | Dorion, Jr. | 206/351 |
| 3,704,545 | 12/1972 | Van Reisen | 206/423 |
| 3,878,941 | 4/1975 | Kelmer | 206/329 |

*Primary Examiner*—William T. Dixson, Jr.
*Attorney, Agent, or Firm*—Woodling, Krost, Granger & Rust

[57] ABSTRACT

Here is disclosed a packing case assembly of a set of decoration lamps including a group of lamps and electric cord connecting the lamps to a plug with the group of lamps being placed at the top and the electric cord being folded in a zig-zag manner and bundled together. The assembly comprises a case and a cap. The case includes a container substantially of a cup-shape to encase the bundled cord and an enlarged portion having an outer diameter larger than the outer diameter of the container and formed integrally with the container to receive the lamps. The cap is removably fixed to the case to cover the lamps. The assembly is compact, and is easy to handle and transport.

4 Claims, 7 Drawing Figures

PACKING CASE ASSEMBLY OF A SET OF DECORATION LAMPS

BACKGROUND OF THE INVENTION

The present invention relates to a packing case assembly of a set of decoration lamps, and more particularly to a packing case assembly which is suitable for encasing a set of Christmas decoration lamps.

Heretofore, packing cases made of cardboard or millboard have been in use for packing Christmas decoration lamps. In these packing cases, a sheet of cardboard or millboard forming a platform with a number of perforations to allow lamps to penetrate therethrough in order that lamps are securely protected and at the same time make a good appearance. But work is required to have the lamps to penetrate the perforations one by one. This work has to be achieved by hand and is time-consuming. Moreover, a packing case of cardboard or the like is bulky, and therefore inconvenient in handling and transporting.

SUMMARY OF THE INVENTION

An object of the present invention is to provide a packing case which minimum in size and is still capable of encasing a set of decoration lamps.

Another object of the present invention is to provide a packing case within which decoration lamps can be energized and which with the bulbs in it can be utilized as a decoration.

A packing case assembly of the present invention comprises a case and a cap. The cap is removably fixable to the case, and is preferably transparent or translucent. The case is formed of a plastic material and comprises a container substantially of a cup-shape to encase the bundled cord portion of a set of decoration lamps. Provided at the upper edge of the container is an enlarged portion having an outer diameter larger than the outer diameter of the container. The enlarged portion is formed integrally with the container and receives a group of lamps of the set. The case may further include a table member and conduit means. The table member is substantially of a truncated cone in shape and is formed by upwardly projecting part of the bottom wall of said container. The table member is provided with a circle of perforated line so that the encircled portion can be punched away by one's thumb to form a perforation sufficient for the plug connected to the cord to pass therethrough. The conduit means is formed by upwardly denting part of the bottom wall partly removing the side wall of truncated conic table member and the side wall of the container. The cap is substantially of a reversed bowl in shape.

A packing case assembly of the present invention can be used to pack a set of decoration lamps, by encasing the bundled cord of a set of lamps in the case, with the enlarged portion receiving the group of lamps, and then covering the lamps by the cap.

When the case includes a table member with a circle of perforated line and conduit means, a plug connected to the cord can be drawn out of the container to be connected to A.C. supply, so that lamps are energized within the case. Thus, the packing case assembly when displayed in a show-window avails itself of decoration while the lamps are still kept in the case. If the cap is transparent or translucent, there is no need to remove it when the assembly is on display. In accordance with the present invention, packing of a set of decoration lamps is much easier and more efficient than with conventional packing case. Also, as the packing case of the present invention is made of a plastic material which is relatively economical, cost of packing can be cut down. Further, compactness of the packing case assembly of the present invention lends itself to relative ease in handling, transporting and storing. Moreover, as the case is self-supporting, the assembly can be displayed by having it stand in a show-window. Decorative effect of the assembly can be increased by energizing the lamps in the case.

BRIEF DESCRIPTION OF THE DRAWINGS

Other features and advantages of the present invention will be apparent from the following description taken in conjunction with the accompanying drawings in which.

DETAILED DESCRIPTION OF THE PREFERRED EMBODIMENTS

Figure 1:
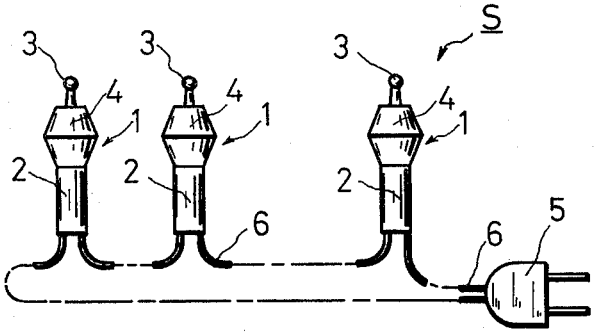
FIG. 1 shows how a set of decoration lamps are connected together, with some only of the lamps being illustrated for the sake of simplicity.

Referring now to FIG. 1, there is shown a set of decoration lamps generally designated at S which is to be encased in a packing case assembly of the present invention. The set of lamps includes a plurality of lamps comprising bulb holder sockets 2, bulbs 3 removably fixed to sockets 2 and reflectors 4 each mounted to socket 2 to enclose bulb 3 and adapted to scatter the light from the bulb 3. Sockets 2 of lamps 1 are connected to plug 5 by electric cord 6.

Figure 2:
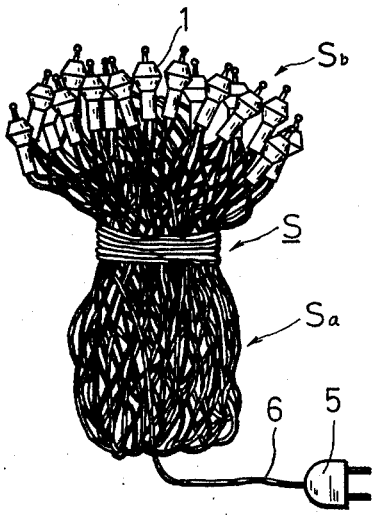
FIG. 2 is an elevational view of a set of decoration lamps ready to be encased, with the cord being folded in a zig-zag manner and bundled, and with the lamps placed at the top.

In order for the set of lamps to be made as compact as possible, cord 6 is folded in a zig-zag manner and bundled while lamps 1 are placed at the top, as shown in FIG. 2, to form bundled cord portion S*a* and a group of decoration lamps S*b*. Thus, the set of lamps are made into an ideal form suitable for being packed with a smallest possible size.

Figure 3:
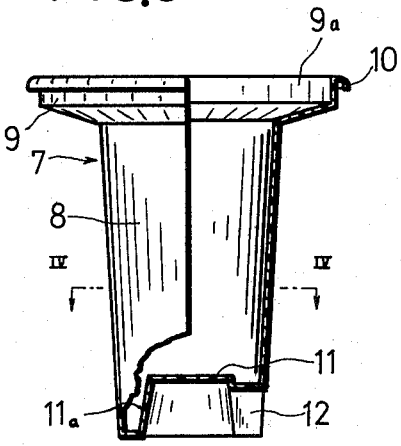
FIG. 3 is an elevational view partly in section of a case of a packing case assembly of the present invention.
Figure 4:
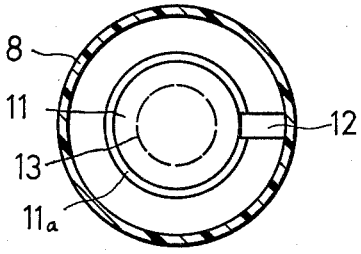
FIG. 4 is an enlarged sectional view along IV—IV of FIG. 3.
Figure 5:
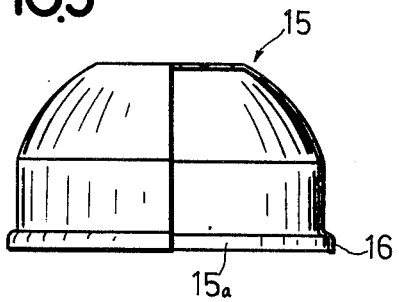
FIG. 5 is an elevational view of a cap which is removably fixable to the case shown in FIG. 3.

FIGS. 3 through 5 show structure of a packing case assembly according to the present invention to encase the set of lamps shown in FIG. 2. Packing case assembly comprises case 7 which is made of a plastic material and which can stand by itself, and cap 15 of a plastic material. Case 7 includes a cup-shaped container 8 to encase bundled cord portion S*a*. Enlarged portion 9 is formed integrally with container 8 at the upper edge of container 8 to receive the group of lamps S*b*. Outer diameter of enlarged portion 9 has a larger diameter than the outer diameter at the upper edge of container 8. Provided along the edge of opening 9*a* enlarged portion 9 is engaging member 10 formed by deflecting the edge downwards.

At the bottom of container 8, there is formed table member 11 by upwardly deforming the bottom wall of container 8 to sustain bundled cord portion.

Conduit means 12 is formed by upwardly denting part of the bottom wall of container 8, partly removing the side wall of container 7 and the side wall of table member 11.

Table member 11 is provided with a circle of perforated line 13 and the encircled portion can be punched away by one's thumb to form a perforation 14. Perforation 14 is large enough for the plug 5 connected to cord 6 to pass.

Cap 15 is made of a transparent or translucent plastic material and is substantially of a reversed bowl in shape. Cap 15 is provided along the edge of opening 15*a* with engaging member 16 to resiliently engage with engaging member of case 7.

The plastic material adapted both for case 7 and cap 15 in the embodiment is polyvinyl chloride. But other plastics such as polystylene can be employed. The thickness of the walls is about 0.7mm.

Figure 6:
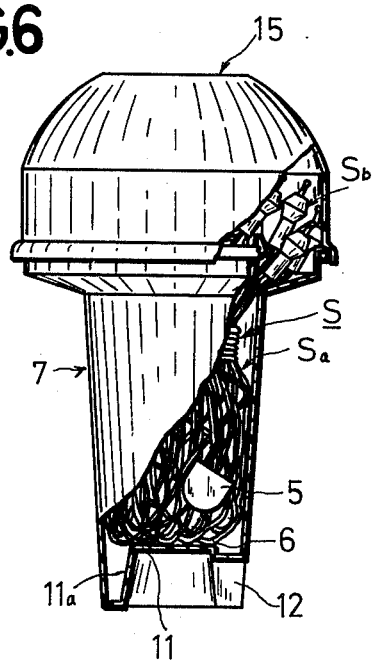
FIG. 6 shows a set of decoration lamps encased in a packing case assembly of the present invention with the case being broken in part.

FIG. 6 shows a set of decoration lamps packed in a packing case assembly. Bundled cord portion S*a* with plug 5 is encased in container 8 and the group of lamps S*b* is received by enlarged portion 9. Cap 15 is by virtue of elasticity of the plastic material snapped onto opening 9*a*.

Thus, the set of lamps can be compactly packed. The compactness makes it convenient to handle, transport and store the set.

Figure 7:
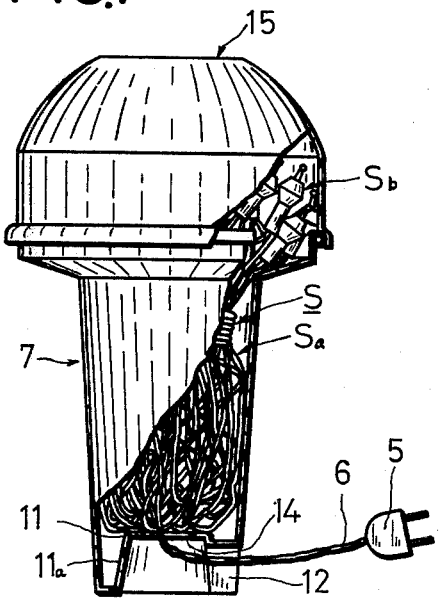
FIG. 7 shows a set of decoration lamps encased in a packing case assembly of the present invention wherein the encircled portion is punched away and the plug is drawn out of the case.

FIG. 7 shows the set of lamps S with plug 5 drawn out of case 7 by punching away the encircled portion of table member 11 to form perforation 14 to allow plug 5 to pass as well as conduit member 12, while case 7 is made to stand by itself. Plug 5 can be connected to external A.C. supply so that lamps are energized while they are in case 7.

In the embodiment above, table member 11 is provided with a circle of perforated line 13 so that the encircled portion can be punched away to form perforation 14. A circle of perforated line may be omitted since perforation 14 can alternatively be formed by cutting away part of table member 14 by a knife. Perforation 14 may, in still another embodiment, be formed at the same time case 7 is formed.

As has been described, according to the present invention packing of a set of decoration lamps is easier and more efficient. Also, as a plastic material which is relatively cheap is used as the material of the case and the cap, cost of packing can be reduced. Further, lamps are packed into a small size case, so that convenience in handling, transporting and storing the lamps is obtained. Moreover, as the case is self-supporting, it can be displayed in a show-window standing by itself. It is also to be understood that the assembly with the lamps energized within the case can also be utilized as a decoration.

While there have been described what are at present considered to be the preferred embodiments of this invention, it will be obvious to those skilled in the art that various changes and modifications may be made therein without departing from the invention, and it is aimed, therefore, in the appended claims to cover all such changes and modifications as fall within the true spirit and scope of the invention.

What is claimed is:

1. A packing case assembly of a set of decoration lamps with the lamps being placed at the top and electric cord connected to the lamps being folded in a zig-zag manner and bundled together, said packing case assembly comprising: a case made of a plastic material having a container substantially of a cup-shape to encase the bundled electric cord; and an enlarged portion with an outer diameter larger than the outer diameter of said container and formed integrally with said container along the upper edge of said container to receive the lamps; and a cap made of a plastic material removably fixed to said opening of said enlarged portion to cover said lamps received by said enlarged portion.

2. A packing case assembly as set forth in claim 1, wherein said case further has a table member substantially of a truncated cone formed by upwardly deforming part of the bottom wall of said container to sustain the bundled cord portion, said table member being provided with a circle of perforated line so that the encircled portion can be punched away by one's thumb to allow the plug connected to the cord to pass; and conduit means formed by denting part of the bottom wall of said container.

3. A packing case assembly as set forth in claim 1, wherein said cap is made of a transparent or translucent material.

4. A packing case assembly as set forth in claim 1, wherein said enlarged portion includes an engaging member along the edge of said opening of said enlarged portion and said cap includes an engaging member along the edge of said cap.

* * * * *